US011142446B2

(12) United States Patent
Heath

(10) Patent No.: US 11,142,446 B2
(45) Date of Patent: Oct. 12, 2021

(54) GRAVITATIONAL WATER DISPENSING SYSTEM

(71) Applicant: Joel Heath, Santa Barbara, CA (US)

(72) Inventor: Joel Heath, Santa Barbara, CA (US)

(73) Assignee: COMPANY OF MOTION, LLC, Santa Barbara, CA (US)

( * ) Notice: Subject to any disclaimer, the term of this patent is extended or adjusted under 35 U.S.C. 154(b) by 0 days.

(21) Appl. No.: 16/895,314

(22) Filed: Jun. 8, 2020

(65) Prior Publication Data

US 2020/0299123 A1 Sep. 24, 2020

Related U.S. Application Data

(60) Provisional application No. 62/859,817, filed on Jun. 11, 2019.

(51) Int. Cl.

| | |
|---|---|
| ***B67D 1/00*** | (2006.01) |
| ***B67D 1/16*** | (2006.01) |
| ***B67D 3/00*** | (2006.01) |
| *B67D 3/04* | (2006.01) |

(52) U.S. Cl.

CPC ..... *B67D 3/0032* (2013.01); *B67D 1/0082* (2013.01); *B67D 1/16* (2013.01); *B67D 3/0083* (2013.01); *B67D 3/0061* (2013.01); *B67D 3/04* (2013.01); *B67D 2001/0089* (2013.01)

(58) Field of Classification Search

CPC ..... B67D 3/0032; B67D 3/0083; B67D 1/16; B67D 1/0082; B67D 2001/0089; B67D 3/04; B67D 3/0061

See application file for complete search history.

(56) References Cited

U.S. PATENT DOCUMENTS

| | | | | | |
|---|---|---|---|---|---|
| 5,332,127 | A * | 7/1994 | White | B67D 3/044 | 222/214 |
| 5,678,737 | A * | 10/1997 | White | B67D 3/044 | 222/484 |
| 6,131,774 | A * | 10/2000 | Thomas | G01F 11/282 | 222/181.2 |
| 6,286,564 | B1 * | 9/2001 | Wallace | B65D 1/06 | 141/18 |
| 6,820,771 | B2 * | 11/2004 | Lassota | A47J 31/50 | 222/185.1 |
| 6,840,407 | B2 * | 1/2005 | Lassota | B67D 1/0871 | 222/183 |

(Continued)

*Primary Examiner* — Frederick C Nicolas

(57) ABSTRACT

Presented is a gravitational water dispensing system that includes a tank portion for water storage, a lid assembly having a top cap and a bottom cap. The lid assembly further includes a vent system that allows atmospheric air to pass from outside into the tank portion, and restrict unintended flow of water outside of the water dispensing system through the vent system while the water dispensing system is in use. The dispensing system further includes a valve with a control handle for controlling flow of water from the tank portion and through a faucet stem laid directly in the direction of gravity. The system further includes a base stand for providing support to the tank portion fitted with the lid assembly, a handle to provide portability for the system, and a drip pan assembly for collecting water dripped during dispensing of water from the water dispensing system.

16 Claims, 7 Drawing Sheets

(56) References Cited

U.S. PATENT DOCUMENTS

| | | | | |
|---|---|---|---|---|
| 6,968,983 | B2 * | 11/2005 | Laible | B67D 7/0294 222/464.1 |
| 7,021,494 | B2 * | 4/2006 | Mazooji | A47K 3/281 222/181.1 |
| 7,287,670 | B2 * | 10/2007 | Yoshida | B67D 3/0003 222/1 |
| 7,832,599 | B2 * | 11/2010 | Laible | B67D 3/0041 222/453 |
| 7,841,492 | B2 * | 11/2010 | Laible | G01F 11/025 222/442 |
| 8,038,035 | B2 * | 10/2011 | Forbis | B65D 47/249 222/153.14 |
| 9,938,130 | B2 * | 4/2018 | Gallagher | B67D 3/043 |
| 10,266,386 | B1 * | 4/2019 | Gallagher | B67D 3/0035 |
| 2010/0213220 | A1 * | 8/2010 | Laible | B67D 7/0294 222/481.5 |

* cited by examiner

GRAVITATIONAL WATER DISPENSING SYSTEM

CROSS-REFERENCE TO RELATED PATENT DOCUMENTS

This patent application claims the benefit of priority of U.S. Provisional Application No. 62/859,817 entitled "Gravitational Water Dispensing System," filed Jun. 11, 2019, which is hereby incorporated herein by reference in its entirety.

FIELD OF THE INVENTION

The present invention relates generally to water dispensers and, more particularly, to a water dispensing system with a unique detachable upside down lid assembly, and an air vent system, configured for managing flow of water from the water dispensing system, while allowing the atmospheric air to get into the water storage tank.

BACKGROUND

Water is essential for human survival. Water is involved in every bodily function from digestion and circulation to the control of body temperature. Water is the majority of our body composition and is in need of constant replenishment. A lack of water in the body may result in dehydration which can cause many health and cognitive issues. For all-day hydration to be effective water management needs to be a spontaneous activity. When water is at your fingertips you drink, when it is not, you do not. In situations when water is not easily accessible when someone is working at their desk, in a meeting or in a workout, people defer to keep working and being thirsty leading to stages of dehydration.

A simple solution to above mentioned problem is to have a large reservoir of water in the places the user spends a great deal of time. Numerous types of water storage and dispenser systems are available, including dispensers for chilled, unchilled (e.g., room temperature), and hot water. However, most of them are either bulky or complex systems, or do not have proper venting or water insulation for integration into our daily lives. Further, in some of existing water dispensing systems refilling of water involves a complex procedure.

A common type of water dispenser for cooling or heating, and dispensing drinking water, such as mineral water, supplied from a bottle is commonly found used in an office and also in a home. An important difficulty related to this type of water dispenser is maintaining a desirable level of cleanliness due to inaccessibility of the components.

Further, lots of inventors in the past have proposed several water dispensers, such as for example, US20050006405 that discloses a water dispenser having a water tank and a body each having an open top. A detachable seat of water inlet and venting pipe is mounted on each opening. The seat of water inlet and venting pipe is directly engaged with the body, while a sealing member is installed between the seat of water inlet and venting pipe and the water tank. The seat of water inlet and venting pipe includes a water inlet and venting pile, allowing the mouth of a bottle inserted therein. Further, a one-way valve is installed at a top portion of the tank, such that air can flow into a shell, while water cannot flow out of the tank via such one-way valve.

WO2014136345A1 discloses a water dispenser for supplying drinking water from a replaceable raw water container filled with drinking water under the effect of gravity.

US20120248141 discloses a drinking water dispenser that heats and cools drinking water supplied from a water supply bottle, and provides heated and cooled drinking water. The dispenser includes a cold water tank, a hot water tank, a water supply pipe, a valve, a by-pass pipe, a by-pass valve and a control unit. The valve opens and closes a water outlet for taking in the drinking water from the water supply bottle according to a level of the drinking water in the cold water tank, limits supply of the drinking water to the cold water tank, and, while the water outlet is shut, suppresses convection of the drinking water and/or heat of the drinking water between the water supply bottle and the cold water tank.

Although, various types of dispenser systems have existed in the past especially bottled type water dispensers, they have their own shortcomings or limitations, thus there exist a need for a novel and more reliable solution.

BRIEF SUMMARY

Accordingly, proposed is a water dispenser with detachable upside down lid assembly for managing gravitational water flow out of the water dispensing system.

It is an objective of the present invention to provide a water dispensing system having a modular design that is quick to disassemble, which in turn helps is accessibility of the integral parts/components of the dispenser. This would help users in maintaining a desirable level of cleanliness of the water dispending system.

It is an objective of the present invention to provide a water dispensing system that is portable.

It is an objective of the present invention to provide a gravitational water dispensing system that provides a proper venting and water insulation.

It is an objective of the present invention to provide a water dispensing system that includes secondary inner threads for selectively mounting additional attachments such as for example, water filtering attachments, flavor pods and so on.

It is another objective of the present invention to provide a water dispensing system that can be easily refilled and used over and again. This is achieved by simply putting the dispensing system upside down and rotatably opening/closing the lid assembly of the dispensing system to open water storage tank.

It is another objective of the present invention to provide a water dispensing system that would provide vacuum insulation.

Embodiments of the present invention disclose a gravitational water dispensing system. The system includes a tank portion for storage of water, a lid assembly comprising of a top cap and a bottom cap, the top cap of the lid assembly rotatably engages to the bottom cap, and the bottom cap of the lid assembly rotatably engages to the tank portion.

According to the embodiment, the lid assembly (120) further comprising a vent system configured to allow atmospheric air to pass from outside into the tank portion, and restrict unintended flow of water outside of the water dispensing system (100) therethrough while the water dispensing system is operational and dispensing water; and a valve (116*b*) with a control handle (112) connected thereto for controlling flow of water from the tank portion (102) and through a faucet stem (116*g*) laid directly in the direction of gravity.

According to the embodiment, the water dispensing system further comprising a handle configured over the tank portion to provide portability to a user of the water dispensing system.

According to the embodiment, the water dispensing system further comprising a drip pan and a drip pan cover having a plurality of holes, wherein the drip pan cover is configured to fit into the drip pan for catching water dripped into the drip pan during dispensing of water from the water dispensing system.

According to the embodiment, the water dispensing system further comprising a base stand configured for providing a support to the tank portion fitted with the lid assembly, wherein the tank portion fitted with the lid assembly is placed upside down over the based stand.

These and other features and advantages of the invention will become apparent from the detailed description below, in light of the accompanying drawings.

BRIEF DESCRIPTION OF THE ACCOMPANYING DRAWINGS

These, as well as other features of the present invention, will become more apparent upon reference to the drawings wherein.

DETAILED DESCRIPTION

As used in the specification and claims, the singular forms "a", "an" and "the" include plural references unless the context clearly dictates otherwise. The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items. Those with ordinary skill in the art will appreciate that the elements in the figures are illustrated for simplicity and clarity and are not necessarily drawn to scale. For example, the dimensions of some of the elements in the figures may be exaggerated, relative to other elements, in order to improve the understanding of the present invention. References to "one embodiment", "an embodiment", "another embodiment", "an example", "one implementation", "some embodiment", and so on, indicate that the embodiment(s) or example(s) so described may include a particular feature, structure, characteristic, property, element, or limitation, but that not every embodiment or example necessarily includes that particular feature, structure, characteristic, property, element or limitation. Further, unless stated otherwise, terms such as "first", "second", are used to arbitrarily distinguish between the elements such terms describe. Thus, these terms are not necessarily intended to indicate temporal or other prioritization of such elements.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In the context of the present invention, the terms "water dispenser,", "water dispensing system,", "gravitational water dispenser,", "gravitational water dispensing system,", and so on are interchangeably used and refer to a water dispenser machine/device/apparatus where water flows from higher level to lower level under the action of gravity.

Figure 1:
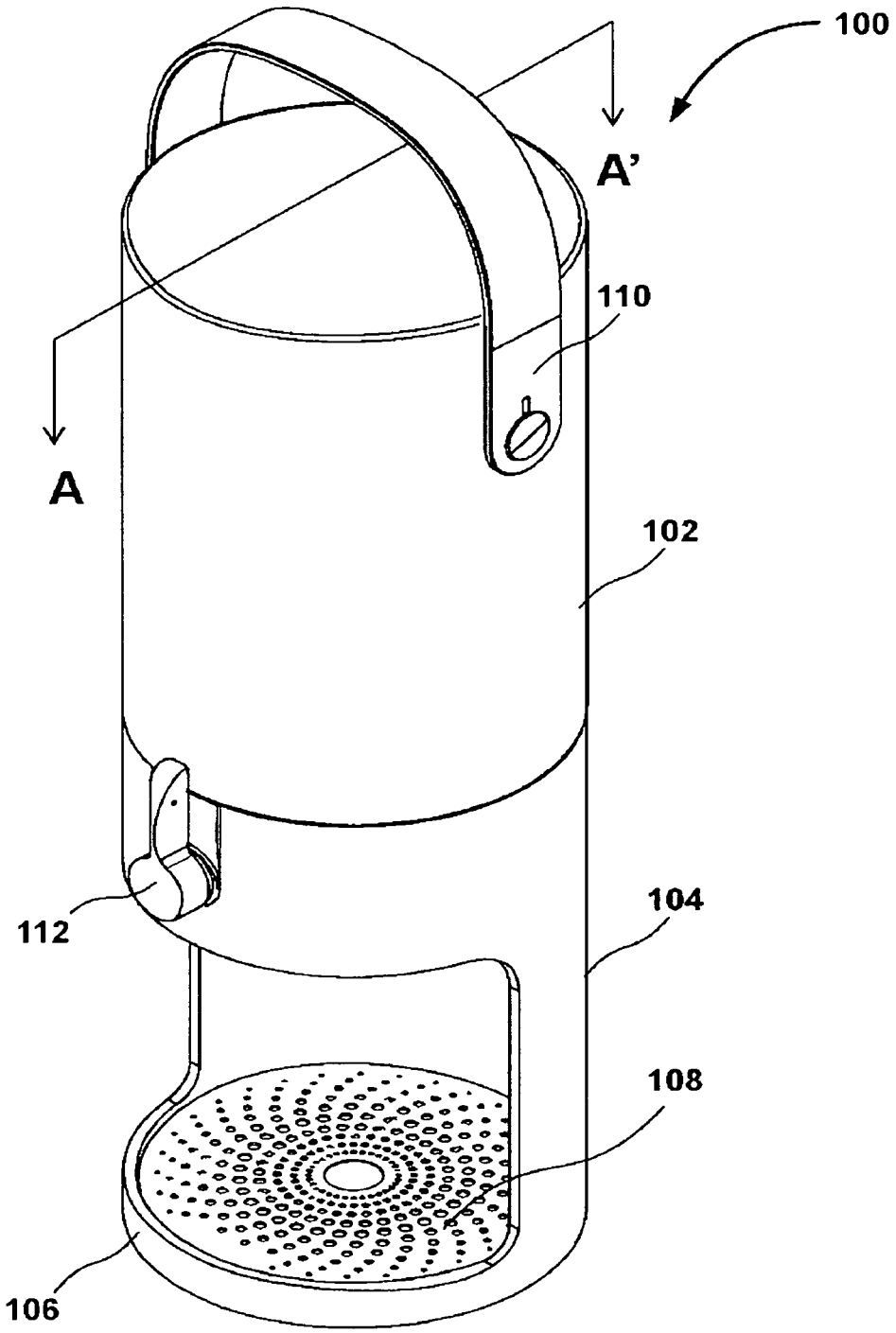
FIG. 1 shows a front perspective view of a gravitational water dispensing system, according to an embodiment of the present invention.
Figure 2:
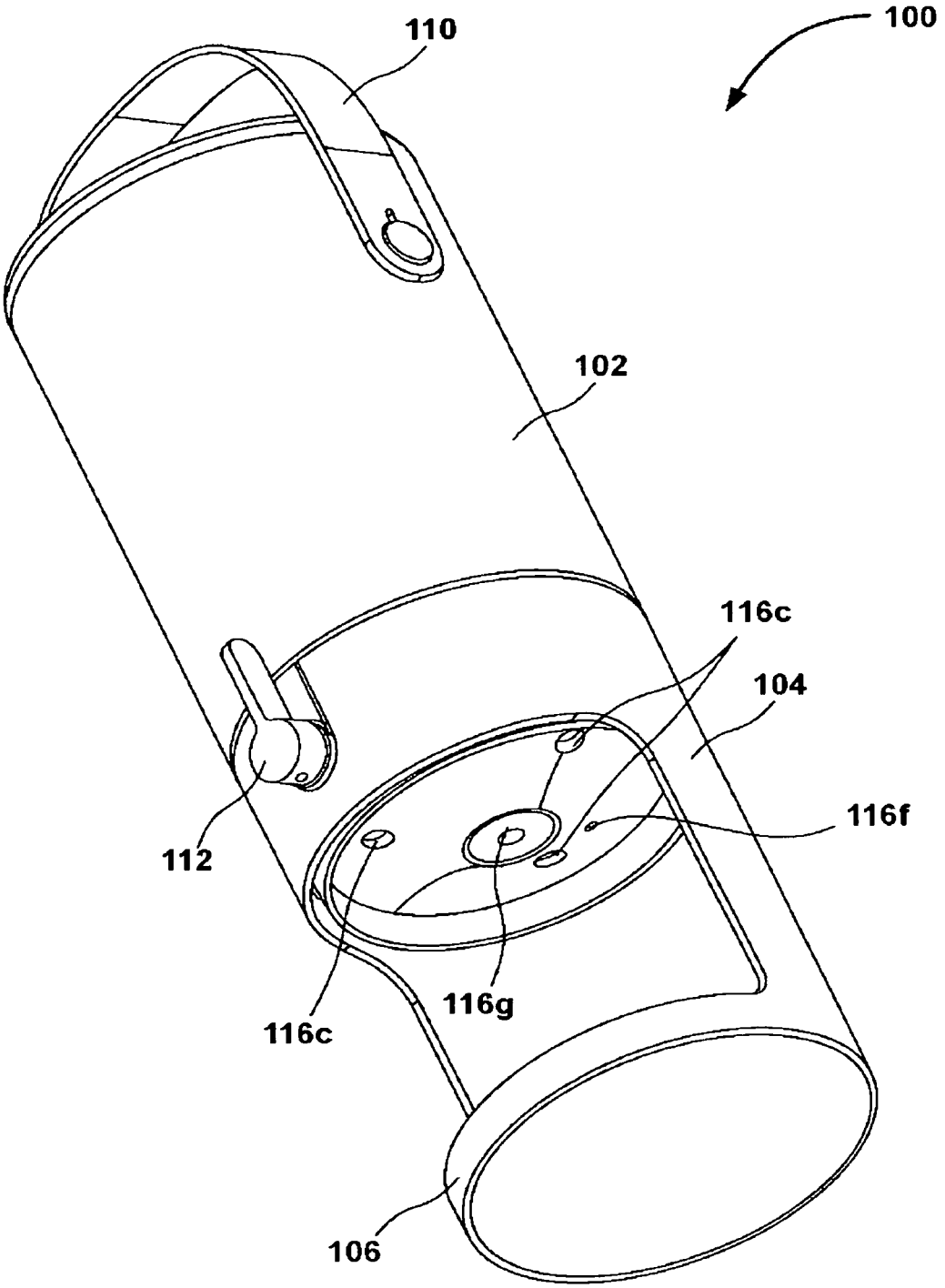
FIG. 2 shows a bottom perspective view of the gravitational water dispensing system of FIG. 1.
Figure 8:
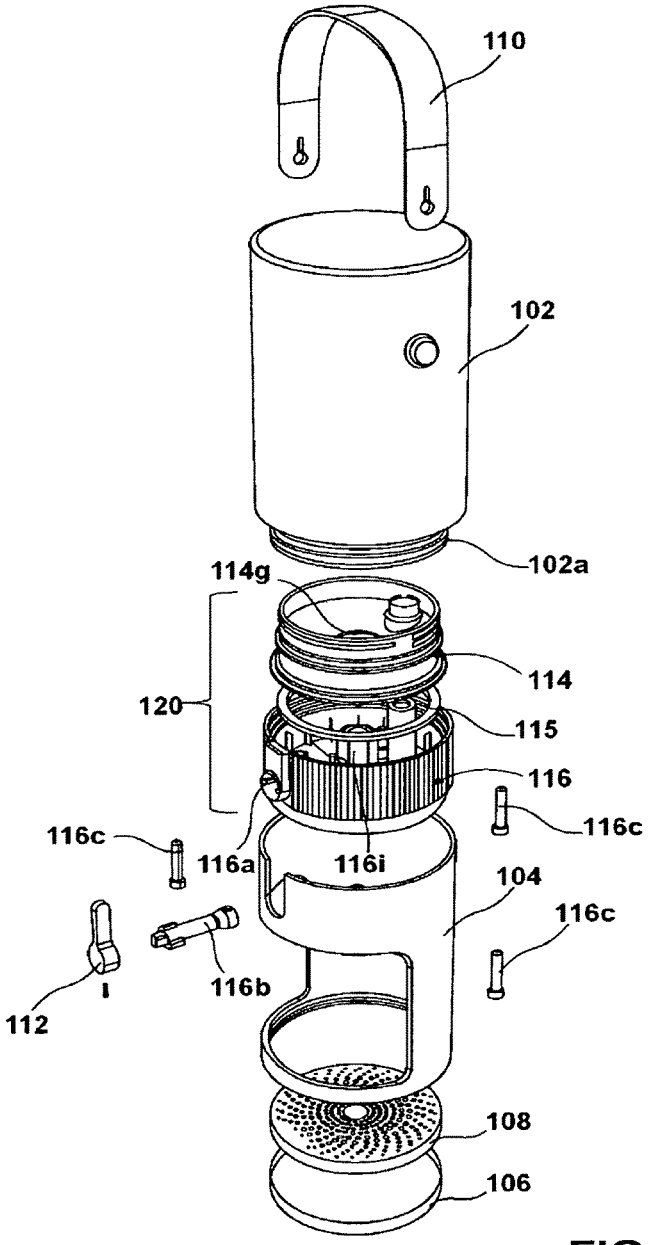
FIG. 8 shows an exploded view of the gravitational water dispensing system of FIG. 1, according to an embodiment of the present invention.

Referring to the accompanying figures, particularly to FIGS. 1, 2 and 8, the proposed water dispensing system 100 includes a tank portion 102, a lid assembly 120, a base stand 104, a drip pan assembly comprising a drip pan cover 108 with a drip pan 106.

The tank portion 102 is adapted for storage of water. The tank portion 102 is shown to be cylindrical, however, it should be understood that the tank portion 102 may be configured in various other shapes. Further, the tank portion 102 may be configured in various capacities to hold different volume of water, which may increase or decrease the size of the tank portion 102. In an example, the tank portion 102 may be configured to hold 2.1 liters of water. In another example, the tank portion 102 may be configured to hold 3.3 liters of water. The tank portion 102 further includes a handle 110 configured on the tank portion 102 to provide portability to a user of the dispenser 100. In an example embodiment, the handle 110 may be configured on or around top area of the tank portion 102 laid horizontally across the two sides of the body of the tank 102 as shown in FIG. 1. In another example, the handle 110 may be configured vertically aligned relative to the body of the tank portion 102 at any side preferably rear side of the tank portion 102. It should be rioted, the handle 110 may be configured in various other locations of the tank portion 102.

Figure 3:
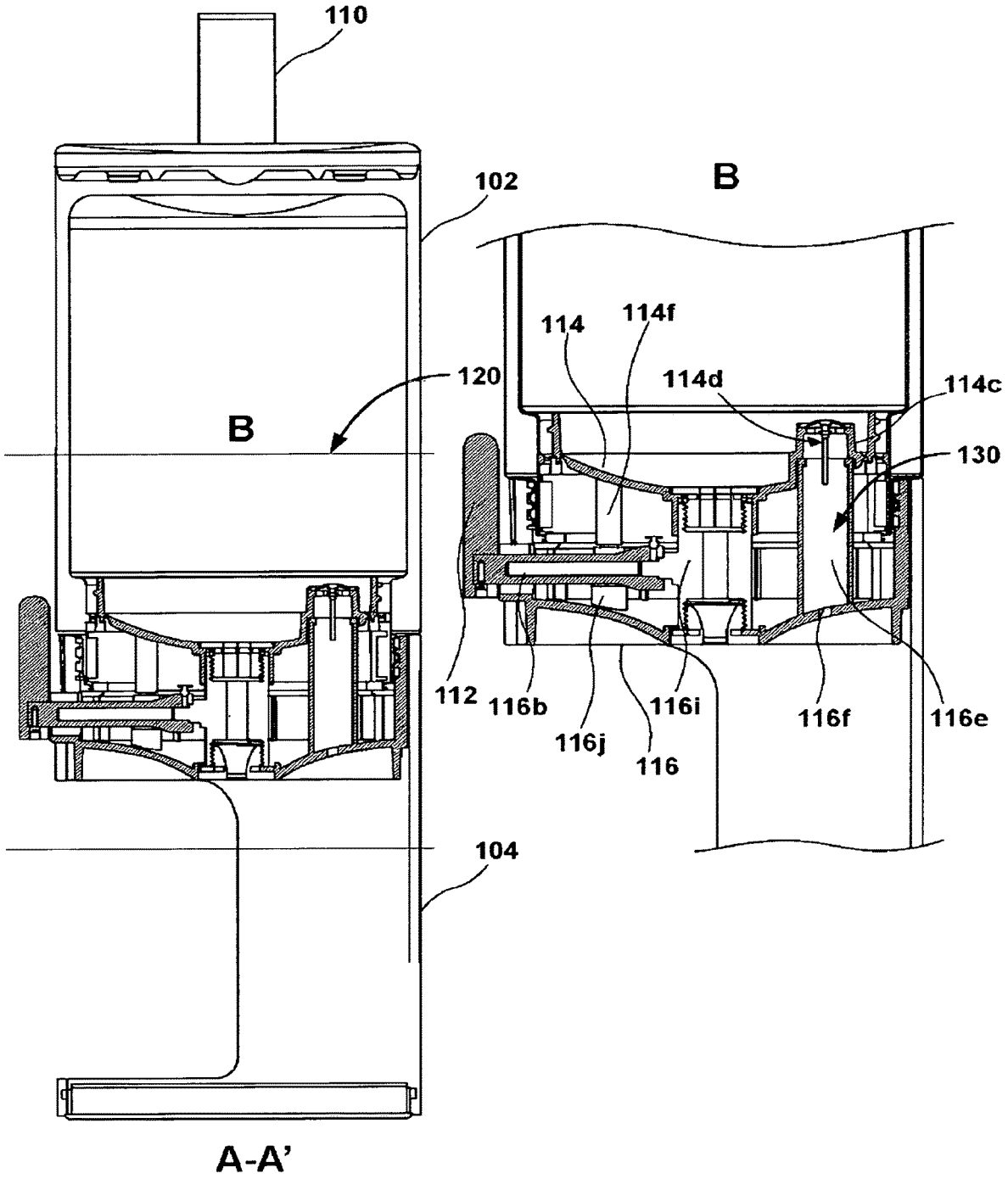
FIG. 3 shows a sectional view of the gravitational water dispensing system of FIG. 1 taken along A-A' and a portion 'B' representing a lid assembly shown in an enlarged view.
Figure 4:
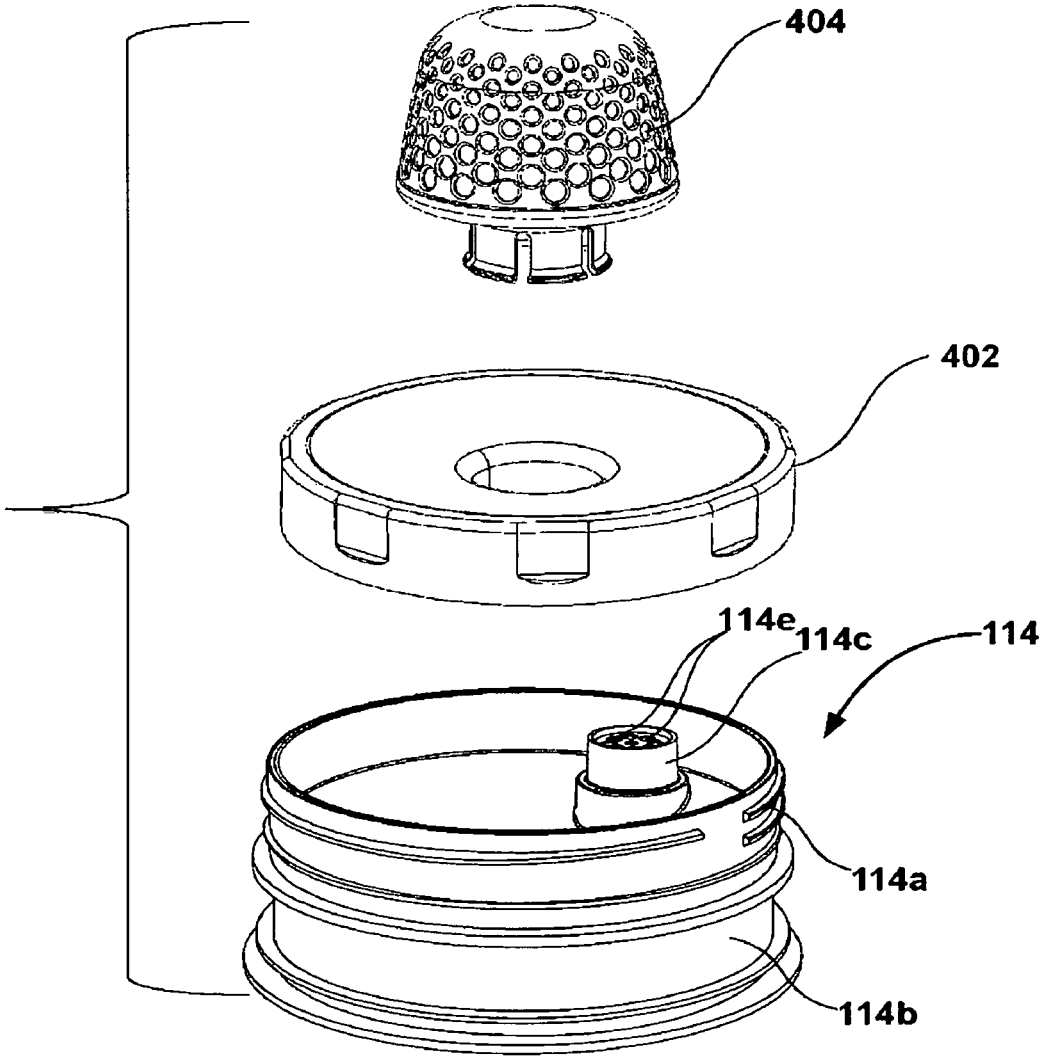
FIG. 4 shows a top cap of the lid assembly of the gravitational water dispensing system of the present invention with an external attachment and a flavor pod in an exploded configuration.
Figure 5:
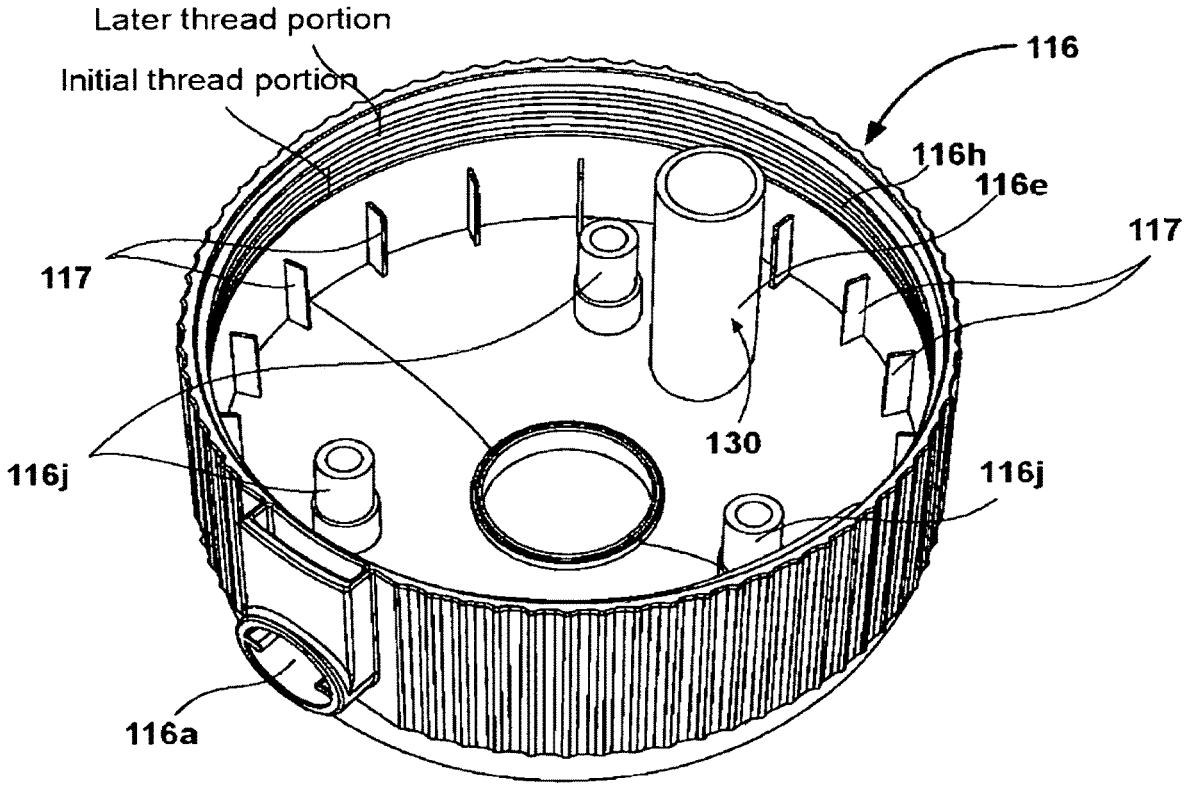
FIG. 5 shows a bottom cap of the lid assembly of the gravitational water dispensing system of the present invention.
Figure 6:
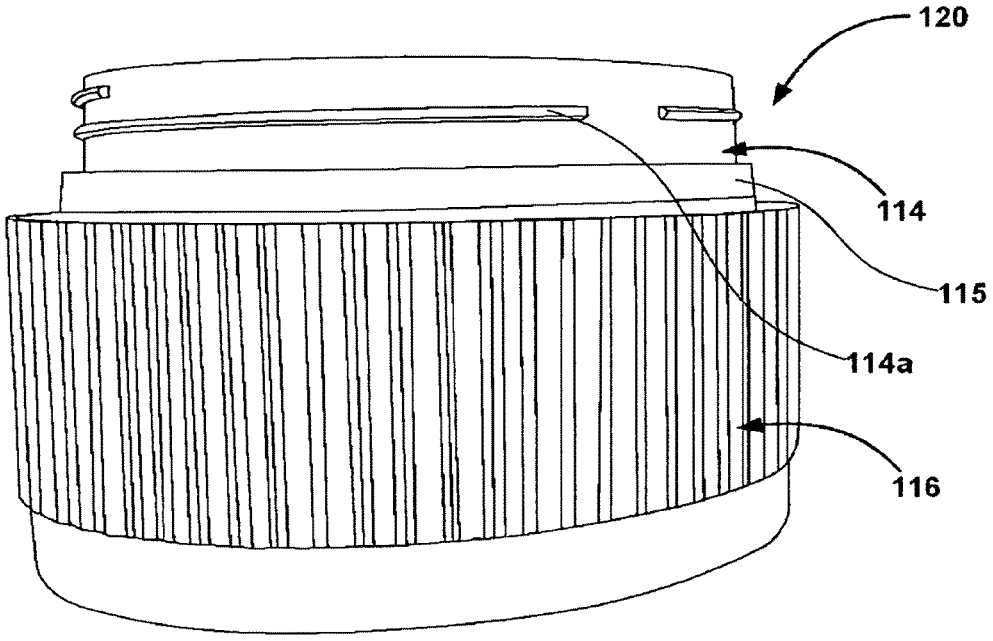
FIG. 6 shows the lid assembly of the present invention with the top cap engaged to the bottom cap.
Figure 7:
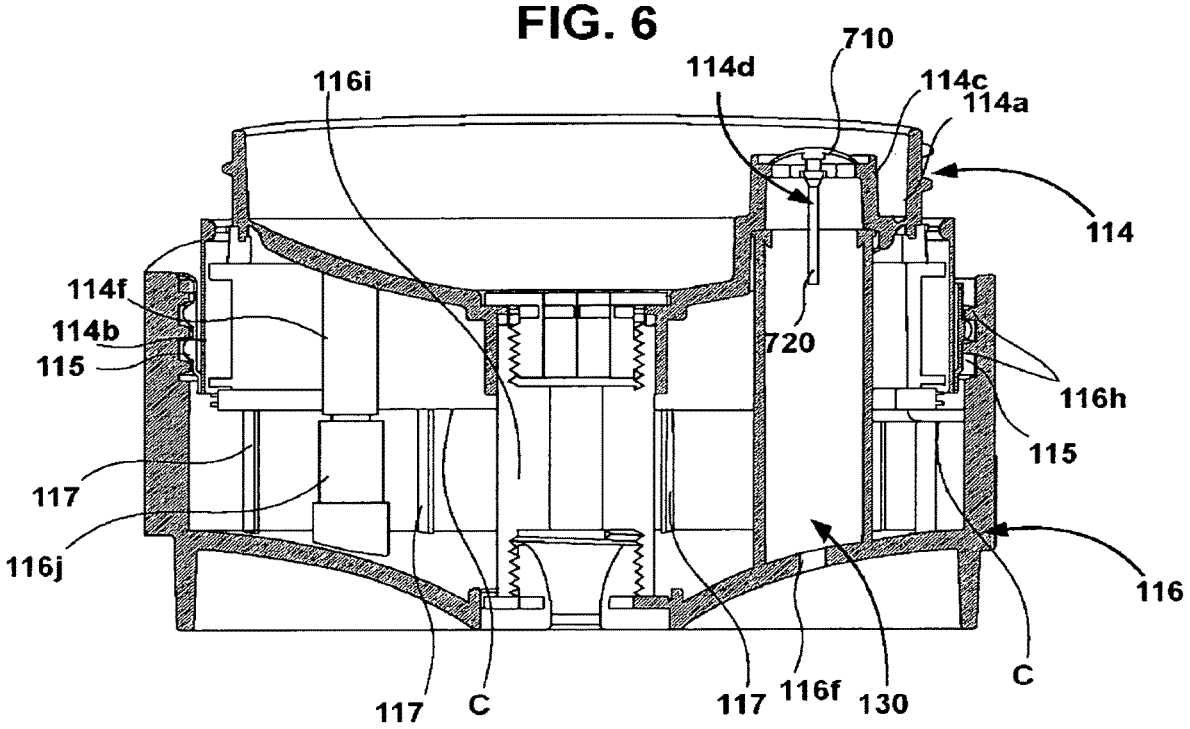
FIG. 7 shows a cross sectional view of the lid assembly with the top cap engaged to the bottom cap.

Referring to FIGS. 3-8, the lid assembly 120 of the water dispensing system 100 comprises a bottom cap 116, and a top cap 114. The top cap 114 includes a set of threads **114*a*, and a circumferential groove 114*k* configured on outer wall surface of the top cap 114. The groove 114*k* of the top cap 114 is configured to embody a gasket 115 that tightly fits into the groove 114*k*. The bottom cap 116 of the lid assembly 120 includes a set of threads 116*k* configured on inner wall surface of the bottom cap 116. The inner wall surface of the bottom cap 116 further includes a plurality of support structures 117, each disposed below the threads 116*h* extending towards the center of the bottom cap 116. The plurality of support structures 117 are configured to provide support to the top cap 114, when the top cap 114 engages to the bottom cap 116. As best seen in FIGS. 6 and 7, when the top cap 114 with the gasket 115 is inserted inside the bottom cap 116 for engagement, a base (referred as 'C') of the top cap 114 sits over the support structures 117, and the groove 114*b* with gasket 115 gets interlocked within the initial thread portion of the threads 116*h* (as shown in FIG. 5) of the bottom cap 116. The gasket 115** embodied by the groove

114*b* facilitate in leakage proof and tight fitting between the top cap 114 and the bottom cap 116. The engagement of the top cap 114 to the bottom cap 116 may further be supported by other means to keep the engagement between top cap 114 to the bottom cap 116 more firm and tight. In an example, a set of screws such as screws 116*e* (as seen in FIG. 8) may be used to further tighten the engagement between the top cap 114 and the bottom cap 116. As shown in FIGS. 5 and 7, the bottom cap 116 may have provisions such as 116*j*, and the top cap 114 may have provisions such as 114*f* for receiving the screws 116*e* to tighten the engagement between the top cap 114 and the bottom cap 116. In operation, when the top cap 114 is inserted inside the bottom cap 116 for engagement, the top cap 114 gets interlocked inside the bottom cap 116 as described above to function as a single unit referred to as "the lid assembly 120" for the purpose of this application. The threads 116*h* (particularly later thread portion as shown in FIG. 5) of the bottom cap 116 of the lid assembly 120 help the lid assembly 120 to rotatably engage to threads 102*a* (as seen in FIG. 8) present at bottom over outer wall surface of the tank portion 102.

According to the embodiment of the present invention as shown in FIG. 4, the threads 114*a* of the top cap 114 are provided as a secondary provision for optionally placing or mounting different pods or attachments 402 such as a filter(not seen), flavor pods 404 that may rotatably engage to the threads 114*a*, when such external attachments are being used with the water dispensing system 100.

According to the embodiment, the lid assembly 120 includes a vent system 130 as shown in FIGS. 3 and 7. The vent system 130 includes an inlet 116*f* configured on the bottom cap 116 of the lid assembly 120, an outlet 114*c* configured on the top cap 114 of the lid assembly 120, and a tubular channel 116*e* (also seen in FIG. 5) configured on the bottom cap 116 and connects the inlet 116*f* of the bottom cap 116 to the outlet 114*c* of the top cap 114. The vent system 130 further includes an outlet closure member 114*d* configured to allow air passage from outside into the tank portion 102, and restrict the flow of water outside from the tank portion 102 while the dispenser system 100 is operated to dispense water.

According to the embodiment, the outlet closure member 114*d* is configured in the form of an umbrella with a top flap 710 and a downward extending pillar 720 as seen in FIG. 7. In an example, the umbrella like outlet closure member 114*d* is made of silicon. However, it should be understood the outlet closure member 114*d* may be made of other suitable materials too such as plastic, rubber etc. The design of the closure member 114*d* is made such that, when it sits over the top of the outlet 114*c*, the pillar 720 of the closure member 114*d* is threaded inside the outlet 114*c* such that the flap 710 sits on top of the outlet coveting one or more vents 114*e* (the vents 114*e* present on top of the outlet 114*c* is best seen in FIG. 4). In implementation, the flap 710 of the closure member 114*d* is made very thin such that the passing air from outside can fold it to enter inside the tank portion 102 while the water dispensing system 100 is operative to dispense water. During operation, when the water is getting dispensed outside from the dispenser 100, the flap of the closure member 114*d* pose restriction to the flow of water through the vent system 130 due to support it receives from the outlet structure 114*c*.

According to the embodiment, the lid assembly 120 further includes a valve 116*b* with a control handle 112 connected thereto as seen in FIGS. 3 and 8. One end of the valve 116*b* fits into a water flow tube 1161 as shown in FIGS. 3 and 7 through an opening 116*a* (seen in FIG. 8) provided on the bottom cap 116. The water flow tube 1161 connects an opening 114*g* on the top cap 114 to a faucet stem 116*g* on the bottom cap 116. The control handle 112 when rotated by the user of the water dispensing system 100 controls the water flow dispensed out of the tank portion 102 through the faucet stem 116*g* laid directly in the direction of gravity (i.e. the faucet stem 116*g* is placed centrally at the bottom of the bottom cap 116 as seen in FIG. 2).

According to the embodiment, as seen in FIGS. 1, 2 and 8, the water dispensing system 100 further includes a base stand 104 configured for receiving and supporting the tank portion 102 fined with the lid assembly 120. The tank portion 102 fitted with the lid assembly 120 is placed upside down over the base stand 104. Also, as seen in FIGS. 1 and 8, the base stand 104 may embody a drip pan assembly having a drip pan 106 and a drip pan cover 108 with a plurality of holes. The drip pan cover 108 is disposed inside the drip pan 106 to catch or collect the unused water that drips out when the dispenser system 100 is dispensing the water. Further in an embodiment, the drip pan 106 may be provided with a soft pad (not seen) attached at its underneath to protect adjoining surfaces where the water dispensing system 100 is placed.

In operation, in order to fill the tank portion 102 with water (or any other similar fluid such as juice intended for dispensement), the user simply need to put the tank portion 102 fitted with the lid assembly 120 upside down and then rotatably disengage the lid assembly 120 from the tank portion 102. Next, the user can fill the water inside the tank portion 102 and then reengage the lid assembly 120 over the tank portion 102 to close an opening of the tank portion 102. Then the user can mount the tank portion 102 with the fitted lid assembly 120 over the base stand 104. Once the tank portion 102 is filled with water, the user can then at any time, rotate the control handle 112 of the water dispensing system 100 to open the control valve 116*b* to allow the water to flow out of the dispenser 100. Once done with dispensing, the user can again rotate the control handle 112 in reverse direction to close the out flow of water from the dispenser 100.

During water dispensement, firstly water flows out of the tank portion 102 and reach into the top cap 114, next the water flows through the opening 114*g* on the top cap 114 and enter into the water flow tube 1161 inside the bottom cap 116, and then finally flow out of the faucet stem 116*g* for collection by the user. During this operation, the vent system 130 allows atmospheric air to pass into the tank portion 102 holding water and prevent any possible air locks inside the tank portion 102 ensuring continual use of the water dispensing system 100.

The water dispenser system of the present invention including associated components thereof (the lid assembly and components associated therewith, the tank portion, the base stand etc) may be made using suitable metals preferably stainless steel or plastic or any other material or any combinations thereof and in variety of dimensions or sizes as needed. The use of material should not be construed as any limitation for implementation of the present invention; however the material is desired to have good durability and at the same time should be inexpensive for the production and affordability of the end users.

Although particular embodiments of the invention have been described in detail for purposes of illustration, various modifications and enhancements may be made without departing from the spirit and scope of the invention.

What is claimed is:

1. A gravitational water dispensing system (100), comprising:

a tank portion (102) for storage of water;

a lid assembly (120) comprising of a top cap (114) and a bottom cap (116), the top cap (114) of the lid assembly (120) rotatably engages to the bottom cap (116), and the bottom cap (116) of the lid assembly (120) rotatably engages to the tank portion (102), wherein the lid assembly (120) further comprising:

a vent system (130) configured to allow atmospheric air to pass from outside into the tank portion (102), and restrict unintended flow of the water outside of the water dispensing system (100) therethrough while the water dispensing system (100) is operational and dispensing the water; and a valve (116*b*) with a control handle (112) connected thereto for controlling flow of the water from the tank portion (102) and through a faucet stem (116*g*) laid directly in the direction of gravity.

2. The water dispensing system (100) of claim 1 further comprising a handle (110) configured over the tank portion (102) to provide portability to a user of the water dispensing system (100).

3. The water dispensing system (100) of claim 1 further comprises a drip pan (106) and a drip pan cover (108) having a plurality of holes, wherein the drip pan cover (108) is configured to fit into the drip pan (106) for catching the water dripped into the drip pan (106) during dispensing of the water from the water dispensing system (100).

4. The water dispensing system (100) of claim 1, further comprising a base stand (104) configured for providing a support to the tank portion (102) fitted with the lid assembly (120), wherein the tank portion (102) fitted with the lid assembly (120) is placed upside down over the based stand (104).

5. The water dispensing system (100) of claim 1, wherein the vent system (130) comprising an inlet (116*f*) configured on the bottom cap (116), an outlet (114*c*) configured on the top cap (114), and a tubular channel (116*e*) configured on the bottom cap (116) connecting the inlet (116*f*) and the outlet (114*c*).

6. The water dispensing system (100) of claim 1, wherein the vent system (130) further comprising an outlet closure member (114*d*) having a flap (710), and a downward extending pillar (720).

7. The water dispensing system (100) of claim 6, wherein the outlet closure member (114*d*) is made of material selected from a group consisting of silicon, rubber, and plastic.

8. The water dispensing system (100) of claim 6, wherein the outlet closure member (114*d*) is configured such that when the outlet closure member (114*d*) is disposed over the top of the outlet (114*c*) on the top cap (114) of the lid assembly (120), the pillar (720) of the outlet closure member (114*d*) gets threaded inside the outlet (114*c*) covering one or more vents (114*e*) present on top of the outlet (114*c*) using the flap (710).

9. The water dispensing system (100) of claim 8, wherein the flap (710) of the outlet closure member (114*d*) is made thin to allow the atmospheric air passing from outside to enter inside the tank portion (102).

10. The water dispensing system (100) of claim 1, wherein the bottom cap (116) of the lid assembly (120) comprising a plurality of support structures (117) disposed below a first set of threads (116*h*) configured over an internal wall of the bottom cap (116), wherein the plurality of support structures (117) provide support to the top cap (114) when the top cap (114) engages to the bottom cap (116).

11. The water dispensing system (100) of claim 1, wherein the top cap (114) of the lid assembly includes a second set of threads (114*a*) adapted for rotatably mounting an external attachment (402) comprising a flavor pod (404).

12. The water dispensing system (100) of claim 1, wherein the top cap (114) comprising a circumferential groove (114*b*) configured on an outer wall surface of the top cap (114).

13. The water dispensing system (100) of claim 12, wherein the groove (114*b*) is configured to embody a gasket 115 that tightly fits into the groove 114*b* and facilitate in tight and leak proof engagement between the top cap (114) and the bottom cap (116).

14. The water dispensing system (100) of claim 1, wherein the engagement of the top cap (114) to the bottom cap (116) is further supported by one or more screws (116*c*) embodied inside one or more provisions (114*f*, 116*j*) configured on the bottom cap (116) and the top cap (114), wherein the one or more screws (116*c*) further tighten the engagement between the top cap (114) and the bottom cap (116).

15. The water dispensing system (100) of claim 1, wherein the valve (116*b*) with the control handle (112) is fitted into a water flow tube (116*i*) through an opening (116*a*) present on the bottom cap (116).

16. The water dispensing system (100) of claim 15, wherein the water flow tube (116*i*) connects an opening (114*g*) present on the top cap (114) to a faucet stem (116*g*) present on the bottom cap (116).

* * * * *